US007150212B2

(12) United States Patent
Lee

(10) Patent No.: US 7,150,212 B2
(45) Date of Patent: Dec. 19, 2006

(54) TORQUE SCREWDRIVER

(76) Inventor: Chang Chuan Lee, No. 429, JhongJheng Rd., Caotun Township, Nantou County (TW)

( * ) Notice: Subject to any disclaimer, the term of this patent is extended or adjusted under 35 U.S.C. 154(b) by 0 days.

(21) Appl. No.: 11/332,325

(22) Filed: Jan. 17, 2006

(65) Prior Publication Data

US 2006/0162510 A1 Jul. 27, 2006

(30) Foreign Application Priority Data

Jan. 26, 2005 (TW) ..... 94102377 A

(51) Int. Cl.
*B25B 23/157* (2006.01)

(52) U.S. Cl. ..... 81/475; 81/473

(58) Field of Classification Search ..... 81/473, 81/475, 478

See application file for complete search history.

(56) References Cited

U.S. PATENT DOCUMENTS 2,969,660 A * 1/1961 Dale et al. ..... 464/86
3,535,958 A * 10/1970 Larson ..... 81/475
3,876,369 A * 4/1975 Behrens ..... 81/475
4,346,633 A * 8/1982 Rendl ..... 81/475
4,901,610 A * 2/1990 Larson et al. ..... 81/473
6,131,489 A * 10/2000 Yang ..... 81/58.3
6,155,147 A * 12/2000 Dzieman ..... 81/473
6,640,674 B1 * 11/2003 Rinner et al. ..... 81/475
7,013,769 B1 * 3/2006 Chen ..... 81/473
2006/0016300 A1 * 1/2006 Bubel ..... 81/475

* cited by examiner

*Primary Examiner*—David B. Thomas

(57) ABSTRACT

A torque screwdriver including a handle formed with a window. An indicator is disposed in the handle near the window. A scale is axially movably mounted in the handle. The scale is drivingly connected with a compression mechanism disposed at one end of the handle and a resilient mechanism. The scale is drivable by the compression mechanism to compress the resilient mechanism. The compression distance is obtainable by means of observing the relative positions between the indicator and the scale through the window. The resilient mechanism is drivingly connected with an axially slidable lower toothed tray for transmitting the torque to an upper toothed tray pivotally mounted at the other end of the handle. The upper toothed tray is drivable by the lower toothed tray to output the torque.

5 Claims, 5 Drawing Sheets

TORQUE SCREWDRIVER

BACKGROUND OF THE INVENTION

The present invention is related to a torque screwdriver equipped with a scale for checking torque value.

A conventional torque screwdriver has a main body in which a female clutch shaft is fitted. An end face of the female clutch shaft is inward recessed to form a tapered recess. A male clutch shaft is formed with a tapered head section adapted to the recess. A spring is mounted between the head section and the socket.

In operation, the main body is turned and an axial force is applied to the male clutch shaft. At this time, the periphery of the head section of the male clutch shaft tightly abuts against the wall of the recess of the female clutch shaft. Accordingly, by means of rotating the male clutch shaft, the female clutch shaft is driven and rotated under frictional force. At this time, a torque is output to drive a work piece.

However, the force exerted onto the female clutch shaft by the male clutch shaft depends on the force applied by an operator. The application force can be hardly unified so that the frictional force between the male and female clutch shafts is always uncertain. As a result, the torque output by the female clutch shaft is varied and the screw can be hardly tightened to a fixed extent. Generally, in the case that the screw is too loose, the screw is apt to detach and drop. In some serious cases, the screw will loosen to lead to damage of the entire machine or even loss of lives.

SUMMARY OF THE INVENTION

It is therefore a primary object of the present invention to provide a torque screwdriver including a main body formed with a window. A first scale member is disposed in the handle near the window. A second scale member is axially movably mounted in the handle. The second scale member is drivingly connected with a compression mechanism disposed at one end of the handle and a resilient mechanism. The second scale member is drivable by the compression mechanism to compress the resilient mechanism. The compression distance is obtainable by means of observing the relative positions between the first and second scale members through the window. The resilient mechanism is drivingly connected with an axially slidable lower toothed tray for transmitting the torque to an upper toothed tray pivotally mounted at the other end of the handle. The upper toothed tray is drivable by the lower toothed tray to output the torque.

According to the above object, the torque screwdriver of the present invention includes a main body formed with an elongated passage and a window communicating with the passage. A first scale member is disposed in the main body near the window. A pair of parallel rails is axially formed on a wall of the passage. A first toothed tray is pivotally mounted in front section of the passage. The first toothed tray has a tool-coupling socket in which a driving tool is installable for outputting torque. A second toothed tray is slidably fitted in the rails for engaging with the first toothed tray. The second toothed tray is connected with a resilient mechanism including a first gasket, a second gasket and a spring positioned between the two gaskets. The second gasket is connected with a second scale member slidably fitted in the rails. The second scale member is drivable by a compression mechanism, whereby the relative positions of the first and second scale members can be seen through the window for adjusting the torque to a necessary value.

The present invention can be best understood through the following description and accompanying drawings wherein:

DETAILED DESCRIPTION OF THE PREFERRED EMBODIMENTS

Figure 1:
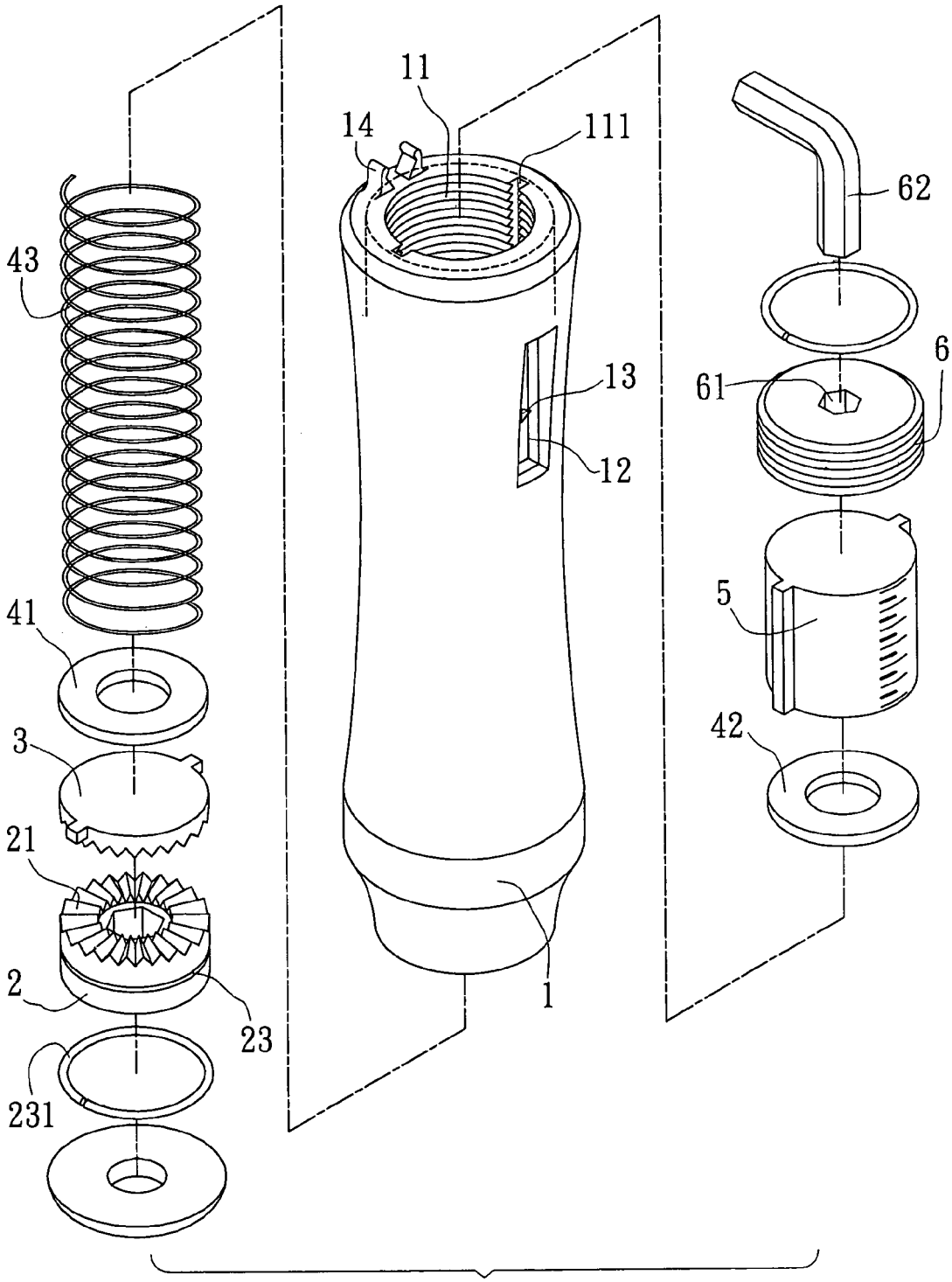
FIG. 1 is a perspective exploded view of the present invention.
Figure 2:
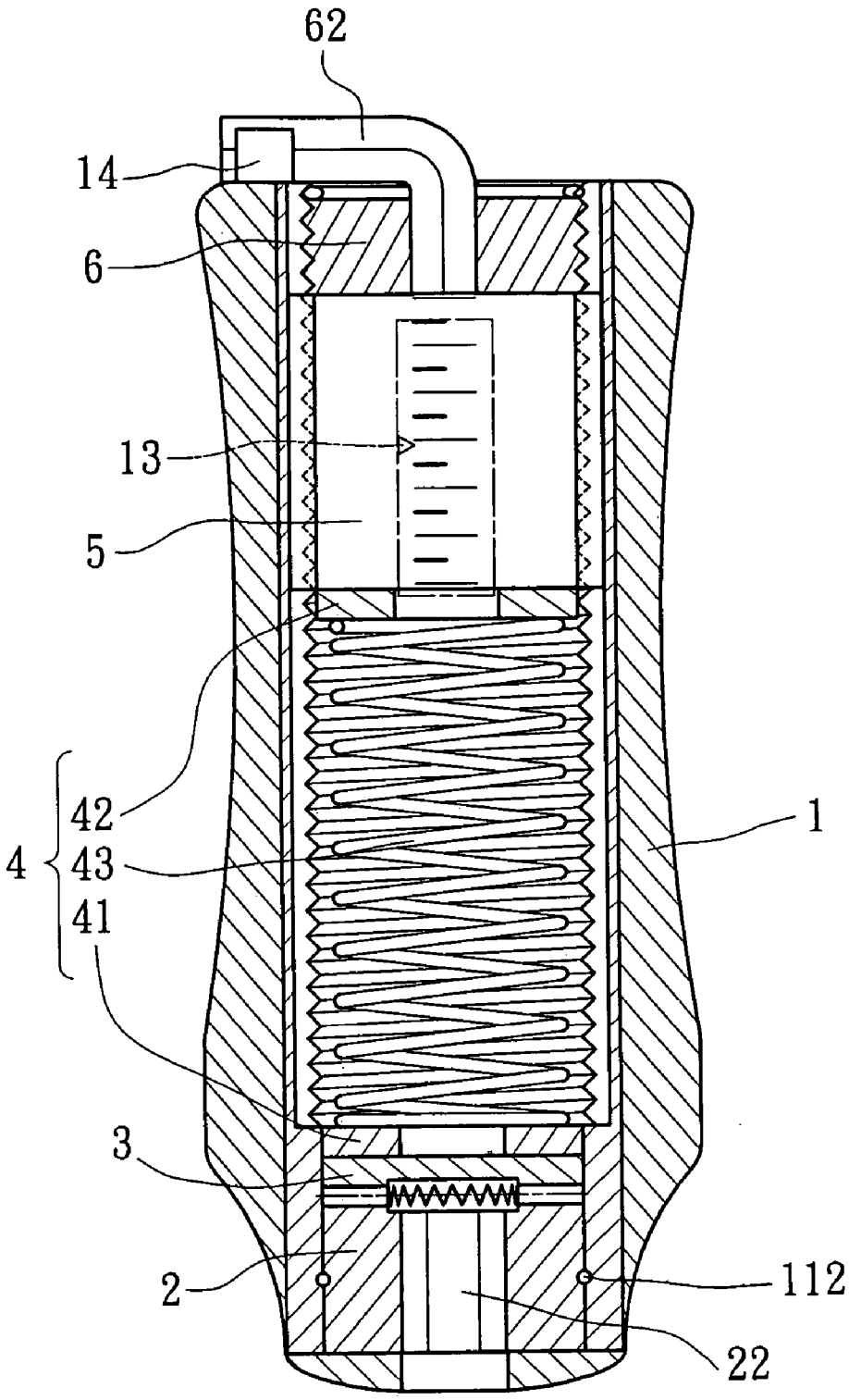
FIG. 2 is a sectional assembled view of the present invention.
Figure 3:
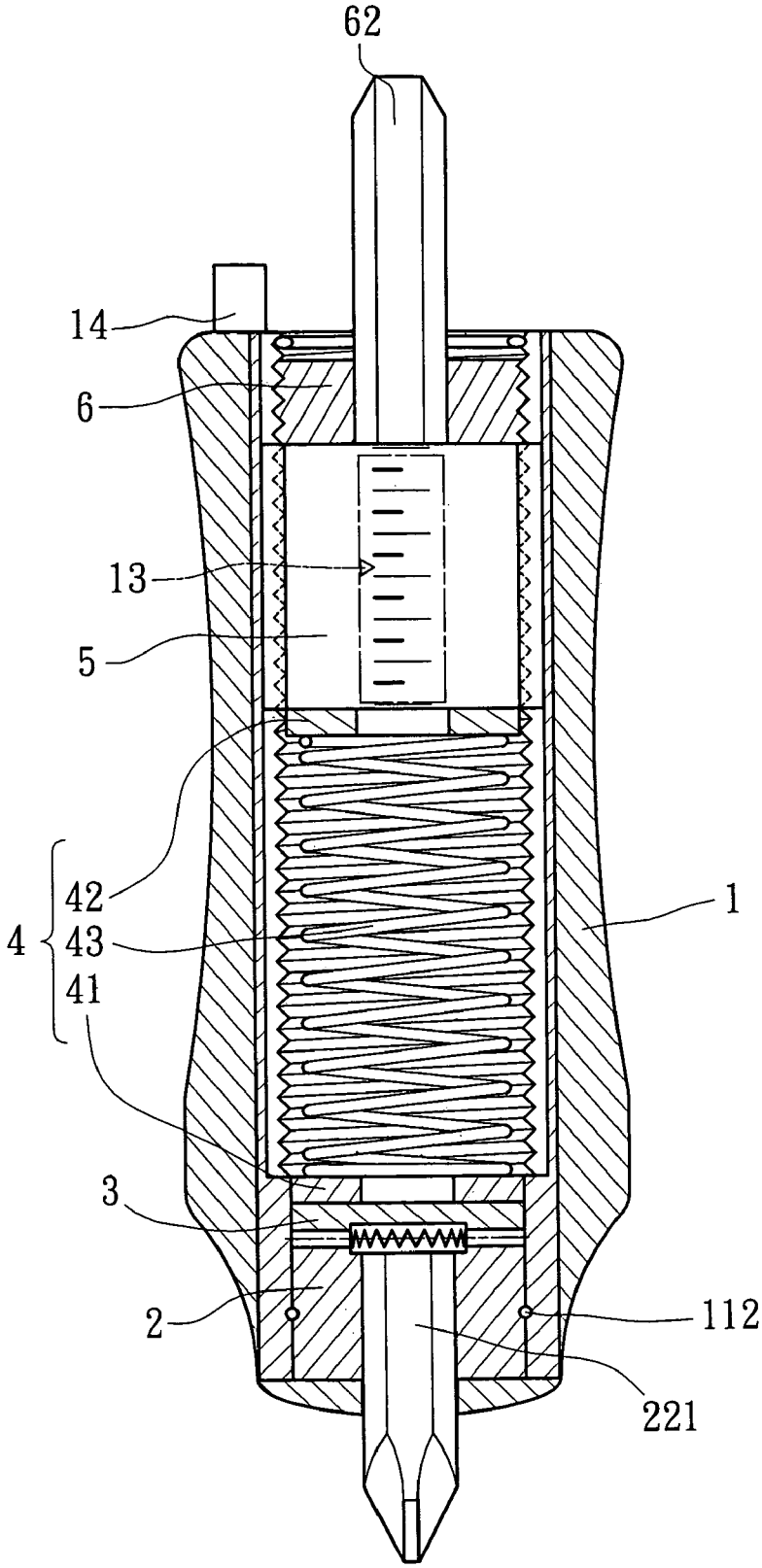
FIG. 3 is a sectional assembled view according to FIG. 2, showing the adjustment of the torque value of the present invention in one state.
Figure 4:
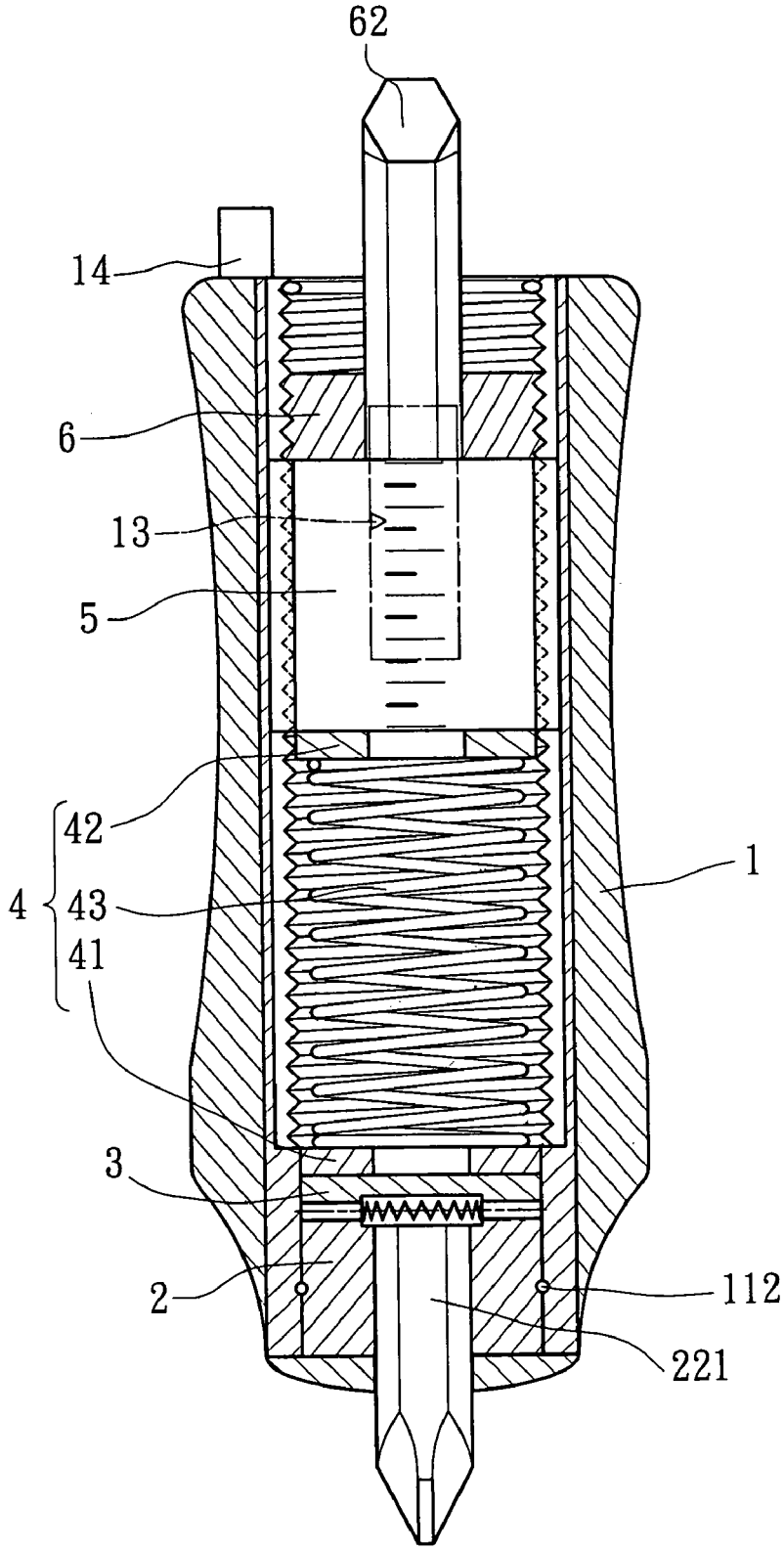
FIG. 4 is a sectional assembled view according to FIG. 2, showing the adjustment of the torque value of the present invention in another state.

Please refer to FIGS. 1 to 4. The torque screwdriver of the present invention includes a main body 1 which is a handle. The handle 11 is formed with an elongated passage 11 and a window 12 communicating with the passage 11. A first scale member is disposed in the main body 1 near the window 12. In this embodiment, the first scale member is an indicator 13. A pair of parallel rails 111 is axially formed on the wall of the passage 11. A first toothed tray 2 is pivotally mounted in front section of the passage 11. The first toothed tray 2 has a ratchet face 21 and a tool-coupling socket 22 in which a driving tool can be installed for outputting torque. In this embodiment, the driving tool is a screwdriver bit 221.

The circumference of the first toothed tray 2 is formed with an annular groove 23 and the wall of the passage 11 is formed with another annular groove 112 corresponding to the annular groove 23. The two annular grooves 23, 112 together form an annular receiving space in which an O-ring 231 is inlaid, whereby the first toothed tray 2 is pivotally mounted in the front section of the passage 11. A second toothed tray 3 is slidably fitted in the rails 111 for engaging with the first toothed tray 2. The second toothed tray 3 is connected with a resilient mechanism 4 including a first gasket 41 and a second gasket 42 as well as a spring 43 positioned between the two gaskets 41, 42. The first gasket 41 is connected with the second toothed tray 3 and the second gasket 42 is connected with a second scale member. In this embodiment, the second scale member is a scale 5. The scale 5 is drivable by a compression mechanism including a rear cap 6. The rear cock 6 is screwed in a rear section of the passage 11. When the rear cock 6 is axially screwed, the scale 5 is pushed, whereby the relative positions of the indicator 13 and the scale 5 can be seen through the window for adjusting the necessary torque. The rear cock 6 is formed with an adjustment hole 61 in which an adjustment member 62 is fitted. The handle 1 is formed with a pair of chuck sections 14 for holding the adjustment member 62.

In operation, the rear cock 6 is screwed toward the scale 5 to push the scale 5. At this time, the scale 5 slides along the rails 111 to push the second gasket 42 and compress the spring 43. The spring 43 further resiliently pushes the first gasket 41 to press the second toothed tray 3 to engage with the first toothed tray 2. When turning the handle 1, the torque is output via the second toothed tray 3 slidably fitted in the rails 111 to the first toothed tray 2. The first toothed tray 2 further drives the screwdriver bit via the tool-coupling socket 22 to output the torque.

Accordingly, an operator can previously calculate or check the safety torque value for tightening a screw. When the torque reaches a set value, the first toothed tray 2 and the second toothed tray 3 will jump away and disengage from each other due to excessively great resistance of the screw. Therefore, the screw will not be over-tightened or under-tightened. This ensures safety. Also, the operator can conveniently adjust the torque.

Furthermore, a user can previously set the necessary torque value for a screw and then check whether the screw is well tightened. When screwing the screw with the present invention, in the case that the original torque value of the screw is under the preset value, the screw will be untightened. Reversely, in the case that the original torque value of the screw exceeds the preset value, the first toothed tray 2 and the second toothed tray 3 will jump away and disengage from each other.

The present invention can be effectively and safely operated by a common person or a technician.

Figure 5:
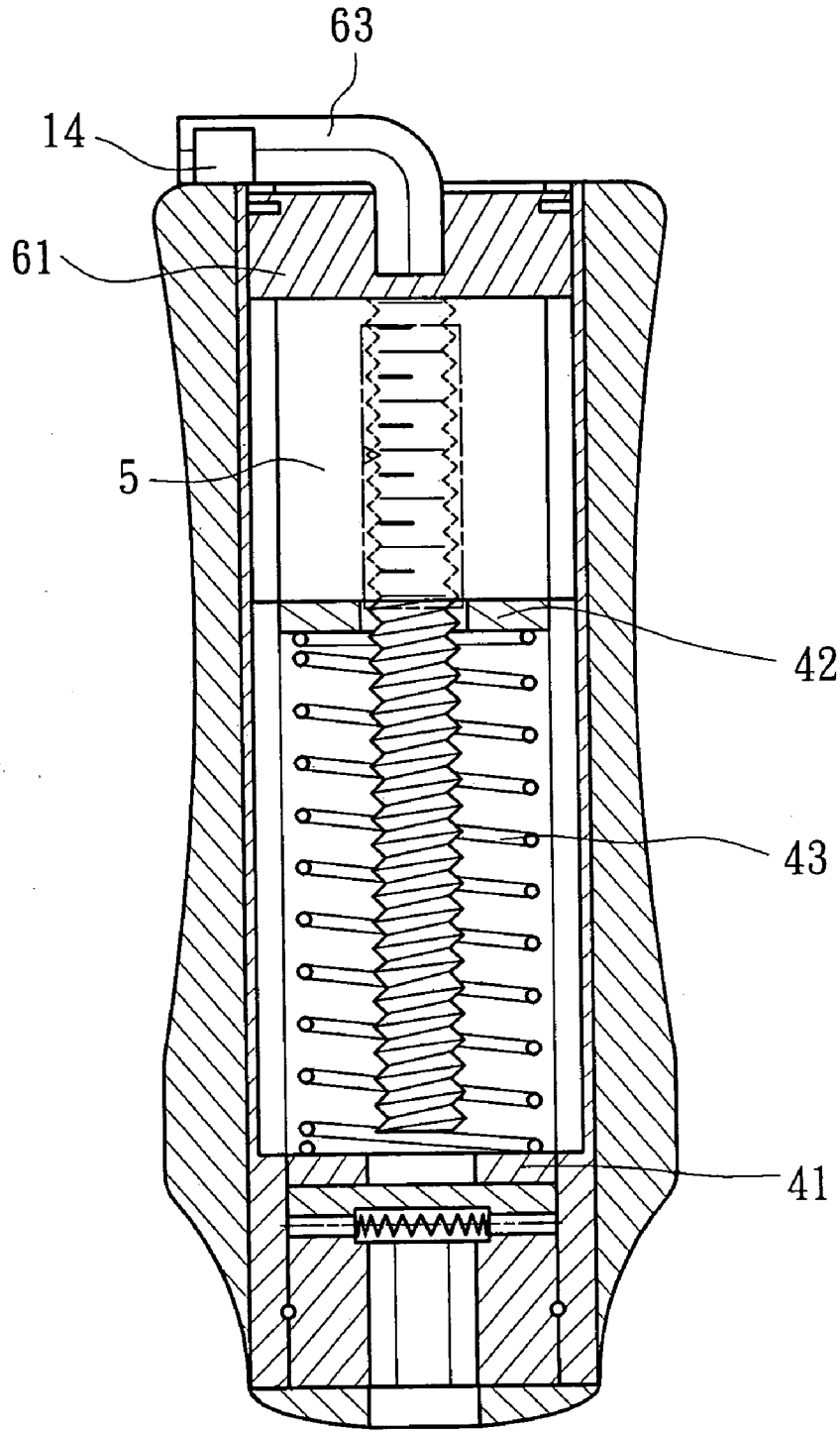
FIG. 5 is a sectional assembled view of a second embodiment of the present invention.

FIG. 5 shows a second embodiment of the present invention, in which the compression mechanism includes a threaded rod 63 pivotally mounted in the rear section of the passage 11. The scale 5 is screwed on the threaded rod 63.

In operation, the threaded rod 63 is turned and the scale 5 is guided by the thread of the threaded rod 63 to move along the rails 111 and push the second gasket 42. At this time, the spring 43 is compressed to preset the torque value.

The above embodiments are only used to illustrate the present invention, not intended to limit the scope thereof. Many modifications of the above embodiments can be made without departing from the spirit of the present invention.

What is claimed is:

1. A torque screwdriver comprising a main body formed with an elongated passage and a window communicating with the passage, a first scale member being disposed in the main body near the window, a pair of parallel rails being axially formed on a wall of the passage, a first toothed tray being pivotally mounted in front section of the passage, the first toothed tray having a tool-coupling socket in which a driving tool is installable for outputting torque, a second toothed tray being slidably fitted in the rails for engaging with the first toothed tray, the second toothed tray being connected with a resilient mechanism including a first gasket, a second gasket and a spring positioned between the two gaskets, the second gasket being connected with a second scale member slidably fitted in the rails, the second scale member being drivable by a compression mechanism, whereby the relative positions of the first and second scale members can be seen through the window for adjusting the torque to a necessary value.

2. The torque screwdriver as claimed in claim 1, wherein the compression mechanism includes a rear cock screwed in rear section of the passage, whereby when screwing the rear cock, the rear cock is moved along the axis of the passage to push the second scale member.

3. The torque screwdriver as claimed in claim 1, wherein the compression mechanism includes a threaded rod pivotally mounted in the rear section of the passage, the second scale member being screwed on the threaded rod.

4. The torque screwdriver as claimed in claim 1, wherein the first scale member is an indicator and the second scale member is a scale.

5. The torque screwdriver as claimed in claim 1, wherein the main body is a handle.

* * * * *